US009017121B1

(12) United States Patent
Amerling

(10) Patent No.: US 9,017,121 B1
(45) Date of Patent: Apr. 28, 2015

(54) OUTBOARD MARINE DRIVE WITH RESIDUAL OIL CHANGE DRAINAGE

(71) Applicant: Brunswick Corporation, Lake Forest, IL (US)

(72) Inventor: Steven J. Amerling, Fond du Lac, WI (US)

(73) Assignee: Brunswick Corporation, Lake Forest, IL (US)

( * ) Notice: Subject to any disclaimer, the term of this patent is extended or adjusted under 35 U.S.C. 154(b) by 143 days.

(21) Appl. No.: 13/771,398

(22) Filed: Feb. 20, 2013

(51) Int. Cl.
*B63H 20/00* (2006.01)
*F01M 11/04* (2006.01)

(52) U.S. Cl.
CPC ..... *F01M 11/0408* (2013.01); *B63H 20/002* (2013.01)

(58) Field of Classification Search
CPC ..... B63B 2770/00; B63H 20/002; B63H 21/386; F01M 11/04
USPC ..... 440/88 I; 184/1.5
See application file for complete search history.

(56) References Cited

U.S. PATENT DOCUMENTS

| | | | | |
|---|---|---|---|---|
| 3,557,767 | A | 1/1971 | Green | |
| 3,908,797 | A * | 9/1975 | Schnepp | 184/1.5 |
| 4,611,559 | A | 9/1986 | Sumigawa | |
| 5,199,914 | A | 4/1993 | Marsh | |
| 5,366,400 | A * | 11/1994 | Kucik | 440/88 L |
| 5,505,643 | A * | 4/1996 | Prasse | 440/88 L |
| 5,857,503 | A * | 1/1999 | Vreeken | 141/332 |
| 6,575,797 | B1 | 6/2003 | Martin et al. | |

* cited by examiner

*Primary Examiner* — S. Joseph Morano
*Assistant Examiner* — Anthony Wiest
(74) *Attorney, Agent, or Firm* — Andrus Intellectual Property Law, LLP

(57) ABSTRACT

An outboard marine drive includes an upper powerhead having an engine, a downwardly depending driveshaft housing, and a lower gearcase having a propulsor for propelling a marine vessel. The engine has a removable oil filter for filtering lubricating oil for the engine, and a drip tray at the interface of the oil filter and the engine for collecting residual oil upon removal of the oil filter. The driveshaft housing has an oil sump below the engine and providing a reservoir for the lubricating oil. The oil sump has a drain fitting for draining oil therefrom. A connection hose extends from the drip tray downwardly to the oil sump drain fitting for delivering residual oil from the drip tray to the oil sump drain fitting and/or a valve.

8 Claims, 3 Drawing Sheets

OUTBOARD MARINE DRIVE WITH RESIDUAL OIL CHANGE DRAINAGE

BACKGROUND AND SUMMARY

The invention relates to outboard marine drives, and more particularly to drainage of residual oil upon changing the oil filter.

An outboard marine drive typically includes an upper powerhead having an engine, a downwardly depending driveshaft housing, and a lower gearcase having a propulsor for propelling a marine vessel. The engine has a removable oil filter for filtering lubricating oil for the engine. Upon removal of the oil filter during an oil change, there can be an oil mess, including residual oil. It is known to provide an oil filter drip tray at the interface of the oil filter and the engine for collecting residual oil upon removal of the oil filter. A fitting may be provided on the drain tray to allow a hose to be attached, which in turn allows the residual oil in the tray to be drained outside of the outboard marine drive cowling. This in turn requires the technician to remove the drip tray drain plug at the fitting, then install and connect the hose, and then, after oil filter replacement, remove the hose and re-install the drain plug after the oil filter change. Hose removal from the drain tray can still be messy. In addition, since the drain hose must be routed outside the cowling, the design of the lower cowling must be such that the lower cowling upper ridge is kept low enough to keep the hose below the drain tray fitting height, allowing the residual oil to completely drain. Alternatively, the lower cowl needs to have a hole for the hose to be routed through, for draining.

The present disclosure arose during continuing development efforts in the above technology.

DETAILED DESCRIPTION

Prior Art

Figure 1:
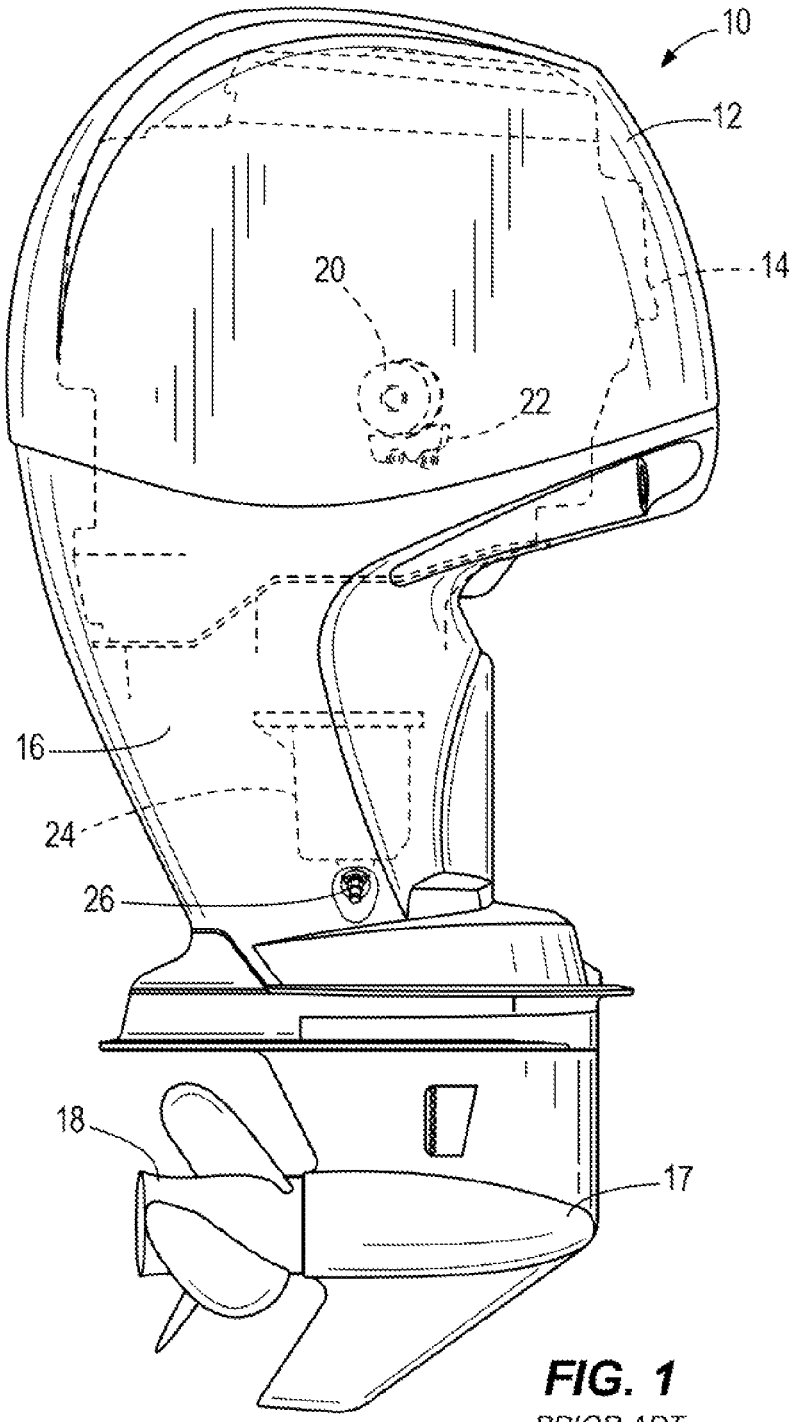
FIG. 1 PRIOR ART
FIG. 1 is a partially schematic view of an outboard marine drive showing prior art.

FIG. 1 shows an outboard marine drive 10 including an upper powerhead 12 having an engine 14, a downwardly depending driveshaft housing 16, and a lower gearcase 17 having a propulsor such as propeller 18 for propelling a marine vessel. The engine has a removable oil filter 20 for filtering lubricating oil for the engine, and a drip tray 22 at the interface of oil filter 20 and engine 14 for collecting residual oil upon removal of the oil filter, e.g. upon threaded removal of the latter. It is known to provide drip tray 22 with a drain fitting and drain plug, and upon removal of oil filter 20, to remove the drain plug and connect a hose to the drip tray fitting to drain oil therefrom during the oil change process, as noted above.

Present Disclosure

Figure 2:
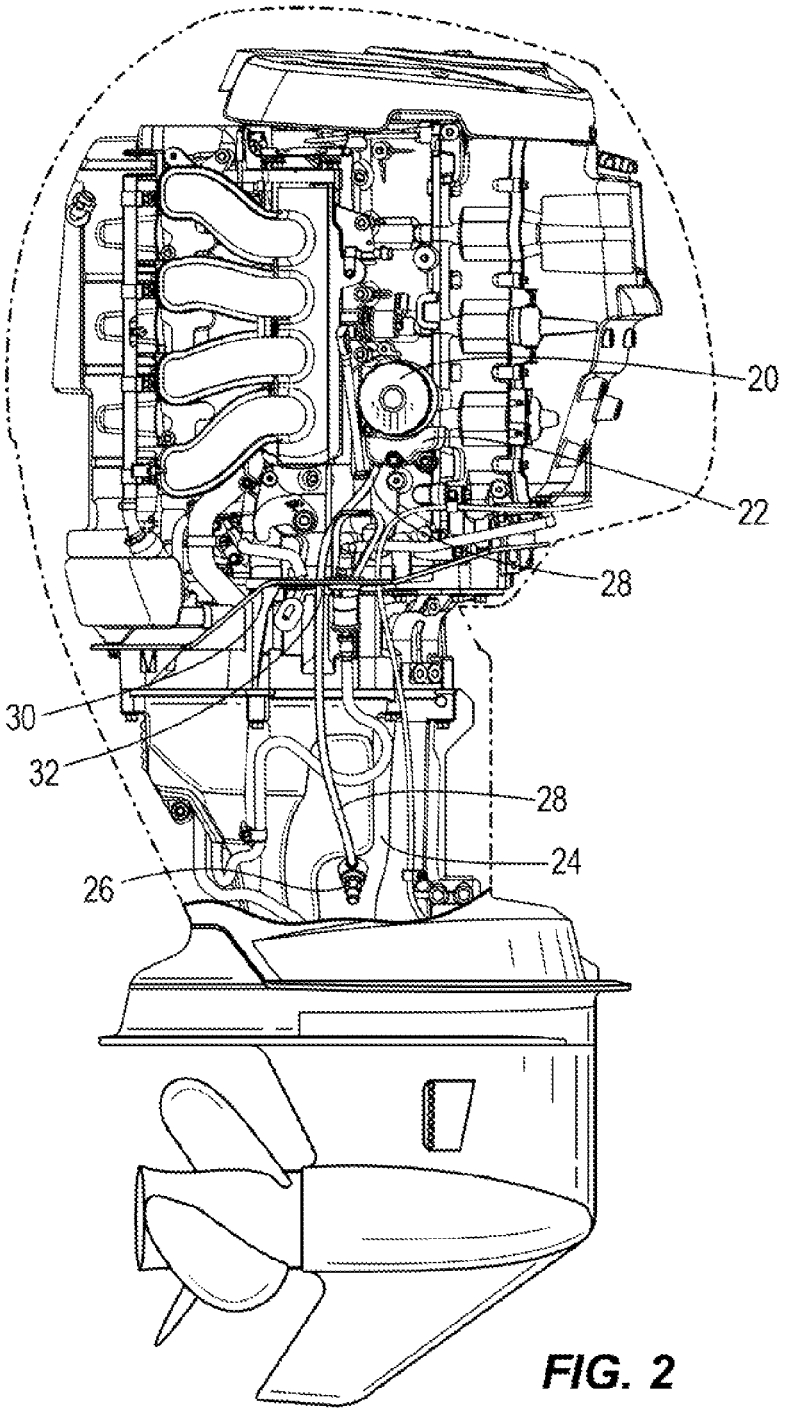
FIG. 2 is like FIG. 1 and shows the present disclosure.
Figure 3:
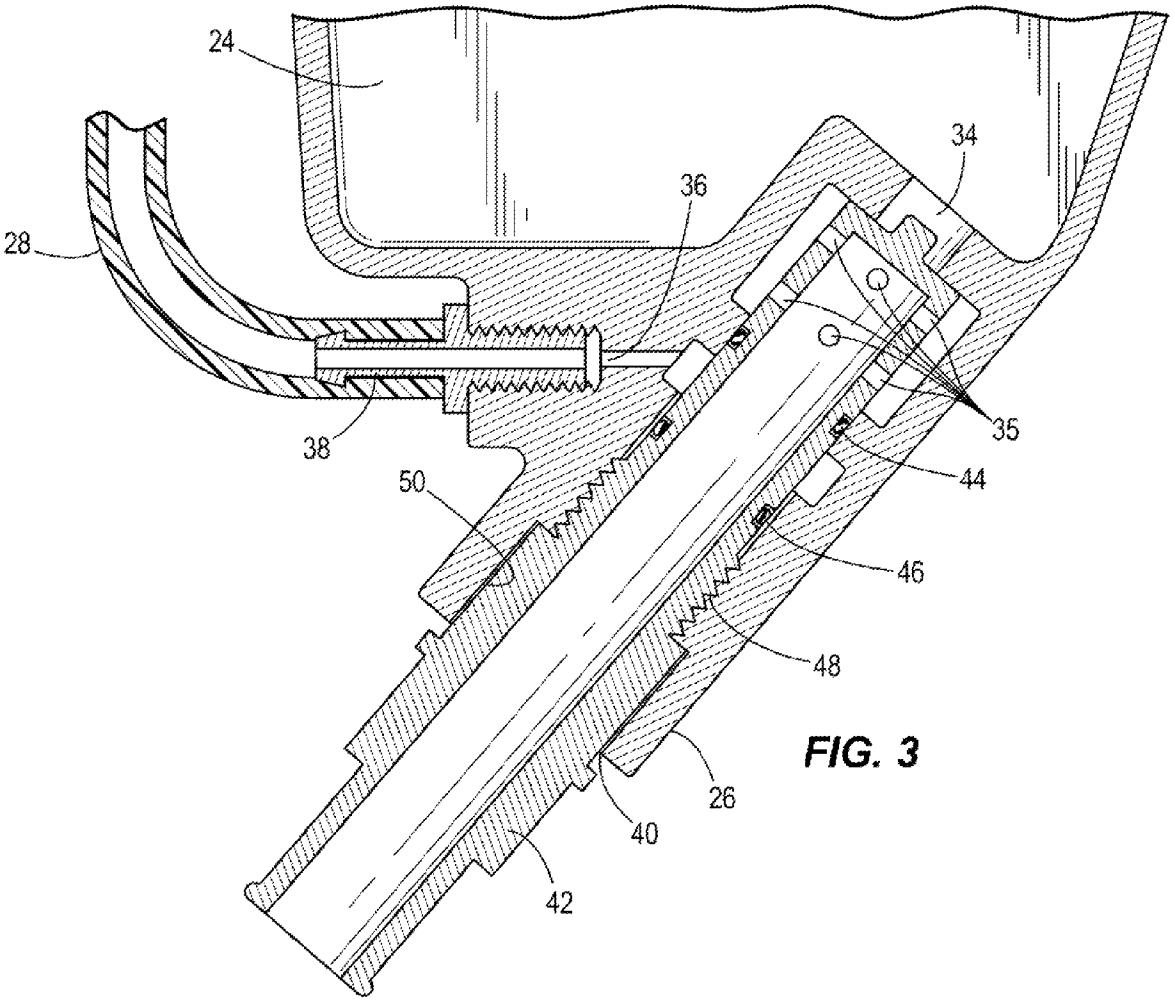
FIG. 3 is an enlarged sectional view of a portion of FIG. 2.

FIGS. 2, 3 illustrate the present disclosure and use like reference numerals from above where appropriate to facilitate understanding.

Driveshaft housing 16 has an oil sump 24 below the engine and providing a reservoir for the lubricating oil. The oil sump has a drain fitting 26 for draining oil therefrom, as is known.

A connection hose 28 extends from drip tray 22 downwardly to oil sump drain fitting 26 for delivering the noted residual oil from the drip tray to the oil sump drain fitting. An adapter plate 30 is between engine 14 and oil sump 24. The adapter plate has an opening 32 therethrough through which connection hose 28 extends downwardly.

Connection hose 28 remains attached to drip tray 22 and to oil sump drain fitting 26 during running of the engine. Accordingly, there is no need to connect and disconnect a drainage hose, thus eliminating the mess otherwise caused thereby during oil filter change by a technician. Oil sump drain fitting 26, FIG. 3, has a first inlet 34 from oil sump 24, a second inlet 36 from drip tray 22 through connection hose 28, which inlet may include a barbed connector such as 38. Oil sump drain fitting 26 has an outlet 40. A valve 42 has a closed condition, FIG. 3, blocking flow of lubricating oil from first inlet 34 to outlet 40, and blocking flow of residual oil from second inlet 36 to outlet 40, e.g. at respective sealing O-rings 44 and 46. Valve 42 has an open condition, e.g. upon threaded removal at threads 48, at least partially removing or withdrawing the cylinder of valve member 42 from the cylindrical bore 50 to open such passage 50 at outlet 40 and thus pass lubricating oil from inlet 34 to outlet 40, and pass residual oil from inlet 36 to outlet 40. In one embodiment, the oil from inlet 34 and/or 36 may drain through drain holes such as 35 in valve member 42 upon partial withdrawal of the latter. Valve 42 in the closed position, FIG. 3, blocks flow of residual oil from inlet 36 to inlet 34. This prevents drip tray oil and debris from entering oil sump 24. In one embodiment, valve 42 has a partially opened condition draining inlet 34, and a fully opened condition additionally draining inlet 36.

The disclosure provides a connection hose 28 extending from an upper end at drip tray 22 to a lower end at valve 42. The valve has an open condition passing residual oil therethrough to drain the residual oil from the drip tray. The valve has a closed condition blocking flow of residual oil therethrough. The connection hose extends downwardly from the engine to the driveshaft housing. The valve and the lower end of the connection hose are in the driveshaft housing. The connection hose remains attached to the drip tray during running of the engine.

The disclosure provides a method for reducing spillage and mess of residual oil when changing an oil filter for an outboard marine drive. The method includes providing a connection hose having an upper end and a lower end, connecting the upper end of the connection hose to the drip tray, connecting the lower end of the connection hose to a valve, collecting residual oil in the drip tray upon removal of the oil filter, and opening the valve to drain the residual oil. In one aspect, the method includes leaving the connection hose attached at the upper end to the drip tray during running of the engine. In one embodiment, the driveshaft housing has an oil sump below the engine providing a reservoir for the lubricating oil, and the oil sump has a drain fitting for draining the lubricating oil therefrom, and the method further includes providing the valve at the oil sump drain fitting with the lower end of the connection hose connected thereto. In one embodiment, the oil sump drain fitting is provided with a first inlet from the oil sump, a second inlet from the drip tray through the connection hose, and an outlet, and the method includes providing the valve with a closed condition blocking flow of the lubricating oil from the first inlet to the outlet, and blocking flow of the residual oil from the second inlet to the outlet. In one embodiment, the method includes providing the valve with an open condition passing the lubricating oil from the first inlet to the outlet, and passing the residual oil from the second inlet to the outlet. In one embodiment, the method includes providing the valve with a closed condition blocking flow of residual oil from the second inlet to the first inlet. In one embodiment, the method includes providing the oil sump drain fitting with a first inlet from the oil sump, a second inlet from the drip tray through the connection hose, and an outlet, and providing the valve with a blocking condition blocking flow of the residual oil from the second inlet to the first inlet.

In the foregoing description, certain terms have been used for brevity, clearness, and understanding. No unnecessary limitations are to be inferred therefrom beyond the requirement of the prior art because such terms are used for descriptive purposes and are intended to be broadly construed. The different configurations, systems, and method steps described herein may be used alone or in combination with other configurations, systems and method steps. It is to be expected that various equivalents, alternatives and modifications are possible within the scope of the appended claims. Each limitation in the appended claims is intended to invoke interpretation under 35 U.S.C. §112, sixth paragraph, only if the terms "means for" or "step for" are explicitly recited in the respective limitation.

What is claimed is:

1. An outboard marine drive comprising an upper powerhead having an engine, a downwardly depending driveshaft housing, and a lower gearcase having a propulsor for propelling a marine vessel, said engine having a removable oil filter for filtering lubricating oil for said engine, and a drip tray at the interface of said oil filter and said engine for collecting residual oil upon removal of said oil filter, said driveshaft housing having an oil sump below said engine and providing a reservoir for said lubricating oil, said oil sump having a drain fitting for draining oil therefrom, a connection hose extending from said drip tray downwardly to said oil sump drain fitting for delivering said residual oil from said drip tray to said oil sump drain fitting, wherein said connection hose remains attached to said drip tray and to said oil sump drain fitting during the running of said engine;

wherein said oil sump drain fitting has a first inlet from said oil sump, a second inlet from said drip tray, and an outlet, and a valve having a closed condition blocking flow of said lubricating oil from said first inlet to said outlet, and blocking flow of said residual oil from said second inlet to said outlet;

wherein said valve has an open condition passing said lubricating oil from said first inlet to said outlet, and passing said residual oil from said second inlet to said outlet;

wherein said valve in said closed position blocks flow of said residual oil from said second inlet to said first inlet; and wherein the lubricating oil and the residual oil flow through the valve.

2. The outboard marine drive according to claim 1 comprising an adapter plate between said engine and said oil sump, said adapter plate having an opening therethrough through which said connection hose extends downwardly.

3. The outboard marine drive according to claim 1, wherein the valve comprises a cylinder having a passage through which the lubricating oil flows and the residual oil flows.

4. The outboard marine drive according to claim 3, wherein the valve comprises a partially opened condition and holes through which the lubricating oil flows into the passage when the valve is in the partially opened condition.

5. An outboard marine drive comprising an upper powerhead having an engine, a downwardly depending driveshaft housing, and a lower gearcase having a propulsor for propelling a marine vessel, said engine having a removable oil filter for filtering lubricating oil for said engine, and a drip tray at the interface of said oil filter and said engine for collecting residual oil upon removal of said oil filter, said driveshaft housing having an oil sump below said engine and providing a reservoir for said lubricating oil, said oil sump having a drain fitting for draining oil therefrom, a connection hose extending from said drip tray downwardly to said oil sump drain fitting for delivering said residual oil from said drip tray to said oil sump drain fitting, wherein said connection hose remains attached to said drip tray and to said oil sump drain fitting during the running of said engine;

wherein said oil sump drain fitting has a first inlet from said oil sump, a second inlet from said drip tray, and an outlet, and a valve having a closed condition blocking flow of said lubricating oil from said first inlet to said outlet, and blocking flow of said residual oil from said second inlet to said outlet;

wherein said valve has an open condition passing said lubricating oil from said first inlet to said outlet, and passing said residual oil from said second inlet to said outlet;

wherein said valve in said closed position blocks flow of said residual oil from said second inlet to said first inlet; and an adapter plate between said engine and said oil sump, said adapter plate having an opening therethrough through which said connection hose extends downwardly.

6. The outboard marine drive according to claim 5 wherein the valve has a partially opened condition draining lubricating oil from said first inlet to said outlet and blocking flow of residual oil from said second inlet to said outlet.

7. The outboard marine drive according to claim 6, wherein the lubricating oil and the residual oil flow through the valve.

8. The outboard marine drive according to claim 7, wherein the valve comprises a cylinder having a passage through which the lubricating oil flows and the residual oil flows.

* * * * *